United States Patent [19]

Kimura

[11] Patent Number: 4,745,399

[45] Date of Patent: May 17, 1988

[54] DEVICE FOR GENERATING AN ALARM SIGNAL IN THE EVENT OF AN ENVIRONMENTAL ABNORMALITY

[75] Inventor: Tetsuo Kimura, Tokyo, Japan

[73] Assignee: Nittan Company, Ltd., Tokyo, Japan

[21] Appl. No.: 933,121

[22] Filed: Nov. 21, 1986

[30] Foreign Application Priority Data

Nov. 25, 1985 [JP] Japan ..... 60-262555

[51] Int. Cl.[4] ..... G08B 19/00

[52] U.S. Cl. ..... 340/521; 340/510; 340/511; 340/518; 340/657; 340/661; 340/632; 250/336.1

[58] Field of Search ..... 340/521, 510, 511, 501, 340/506, 522, 870.18, 870.09, 870.16, 870.21, 632, 612, 618, 657, 661, 518, 634, 505, 825.07, 825.1, 825.06; 250/336.1, 339, 346

[56] References Cited

U.S. PATENT DOCUMENTS 3,744,043 7/1973 Walden et al. ..... 340/521
4,390,869 6/1983 Christen et al. ..... 340/521
4,421,984 12/1983 Farquhar et al. ..... 250/339
4,423,326 12/1983 Ball ..... 340/578
4,638,304 1/1978 Kimura et al. ..... 340/511

*Primary Examiner*—Donnie L. Crosland
*Attorney, Agent, or Firm*—Hill, Van Santen, Steadman & Simpson

[57] ABSTRACT

A device for generating an alarm signal in the event of an environmental abnormality has multiple sensors, with a multiplier associated with each sensor, an adder, and a comparator. The sensors are disposed in respective sensing volumes, which may be different. The sensors detect a level of smoke, heat, gas or other environmental abnormality within each sensing volume, and convert the level into an electrical analog signal. The associated multiplier multiplies a coefficient proportional to the sensing volume for the associated sensor with the analog signals from the sensor. The adder adds the outputs of the multipliers. The comparator generates an alarm signal at an output thereof when the output of the adder exceeds a predetermined value.

7 Claims, 2 Drawing Sheets

DEVICE FOR GENERATING AN ALARM SIGNAL IN THE EVENT OF AN ENVIRONMENTAL ABNORMALITY

BACKGROUND OF THE INVENTION

1. Field of the Invention

The present invention relates to a device for detecting an environmental abnormality such as a gas leakage or a fire and providing an alarm signal.

2. Description of the Prior Art

Conventionally, a monitoring device for fire, gas, or the like detects temperature, smoke density, and gas concentration and produces an alarm when the detected level reaches a predetermined value. In general, the number of sensors is determined in accordance with the floor area of a room to be monitored. Detection signals obtained from sensors are discriminated by a single reference value so that an abnormality is detected regarding the overall detection area as a single area. In some devices, a central monitoring unit performs total abnormality discrimination from detection signals (analog signals) of a plurality of sensors, however, temperatures and smoke densities are measured and discriminated by a single measure.

As described above, a monitoring device for fire, gas, or the like performs discrimination of a fire or a gas leakage by detection signals of one or more sensors. Levels of a fire or a gas leakage are detected for the overall detection area. If sensing areas for respective sensors differ from each other, an alarm cannot be produced according to differences in scale of a fire or a gas leakage. If a fire is to be detected by temperature, for example, sensors are provided in units of predetermined floor areas, however the heights of the respective ceilings to which each sensor is attached may be different. Fires of an identical scale will thus be detected as fires of different levels in accordance with locations of fires and an alarm may be delayed.

SUMMARY OF THE INVENTION

It is an object of the present invention to provide a device for generating an alarm signal in the event of an environmental abnormality which is capable of discriminating an environmental abnormality such as a fire or a gas leakage according to differences in scale of such an abnormality.

It is another object of the present invention to provide a highly reliable device for generating such an alarm signal wherein misalarming, non-alarming, or delay of an alarm is extremely reduced.

In accordance with the principles of the present invention, there is provided a device for generating an alarm signal in the event of an environmental abnormality having a plurality of sensors for detecting a level of smoke, heat, gas and the like and converting the level into an electrical analog signal, multiplying means for multiplying coefficients proportional to sensing volumes for the respective sensors with the analog signals at the sensors, adding means for adding outputs of the multiplying means, and comparing means for generating an alarm signal output when the output of the adding means exceeds a predetermined value.

DESCRIPTION OF THE PREFERRED EMBODIMENTS

Figure 1:
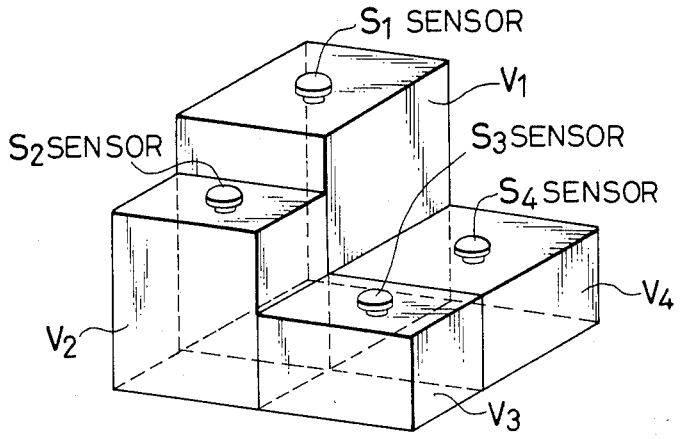
FIG. 1 is a perspective view for explaining the principle of a method of detecting environmental abnormality according to the present invention.

FIG. 1 explains the principle of the method of discriminating environmental abnormality according to the present invention. It is assumed that heights of ceiling differ, and that a non-partitioned monitor zone is present. Monitoring spaces for respective sensors $S_1$ to $S_4$ attached to the ceilings or the like are appropriately determined and respective sensing volumes are designated by reference characters $V_1$ to $V_4$. Naturally the sensing volume are effective volumes so that the volumes take into account of air circulation and ventilation, partitions and the like in each sensing area. When temperature sensors, for example, are used as the sensors $S_1$ to $S_4$, a heat capacity Q of a heat source such as a fire is given by $Q=t_1 \cdot V_1 + t_2 \cdot V_2 + t_3 + t_4 \cdot V_4 + QL$ where $t_1$ to $t_4$ are temperatures detected by the sensors $S_1$ to $S_4$, and QL is heat loss from wall surfaces, floors, ceilings, openings, and the like. Therefore, since the heat loss QL and the sensing volumes $V_1$ to $V_4$ can be determined in advance, the scale of the heat source can be estimated based on the temperatures $t_1$ to $t_4$ detected by the sensors $S_1$ to $S_4$. The sensors $S_1$ to $S_4$ measure not only temperature but also smoke density or gas concentration so that levels of smoke or gas leakage can be estimated. As described above, since the discriminating method of the present invention takes into consideration areas and heights of monitor zones for the respective sensors, a scale of environmental abnormality can be determined, and misalarming and non-alarming in the discriminating results can be reduced to a minimum.

An embodiment of the device for generating the alarm signal in the event of an environmental abnormality of the present invention according to the above discriminating method will now be described.

Figure 2:
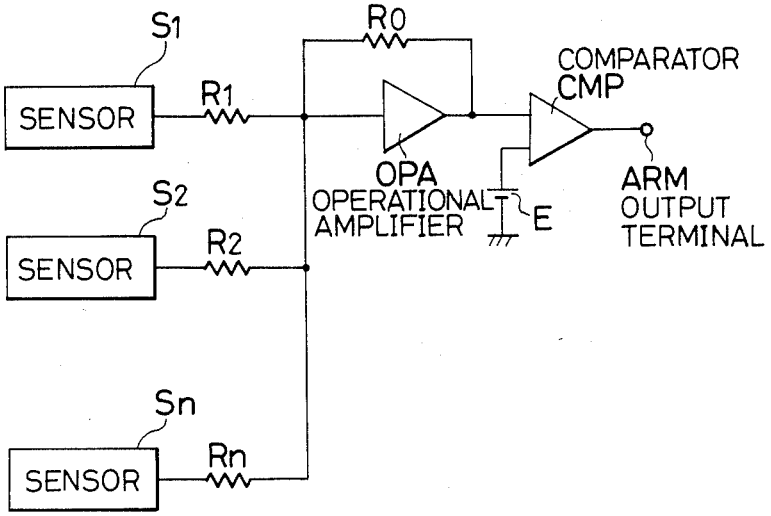
FIG. 2 is a block diagram of a device for generating an alarm signal in the event of an environmental abnormality according to an embodiment of the present invention.

FIG. 2 is a block diagram of an embodiment of the device for generating an alarm signal in the event of environmental abnormality according to the present invention. The device comprises sensors $S_1$ to $S_n$, resistors $R_0$ to $R_n$, an operational amplifier OPA, and a comparator CMP which compares an output of the operational amplifier OPA with a predetermined comparison voltage $E_1$. The sensors $S_1$ to $S_n$ detect a level of smoke, heat, or gas and convert it into and output an electrical analog signal. Output voltages of sensors $S_1$ to $S_n$ are supplied to the operational amplifier OPA through the resistors $R_1$ to $R_n$. Assuming that the output voltages of the sensors $S_1$ to $S_n$ are $e_1$ to $e_n$, and that the gain of the operational amplifier OPA is sifficiently high, an output voltage $e_0$ is given by $e_0=-\{(R_0/R_1)e_1+(R_0/R_2)e_2+\ldots+(R_0R_n)e_n\}$. Therefore, when coefficients of $R_0/R_1$, $R_0/R_2$, . . . , $R_0R_n$ are made proportional to sensing volumes for the sensors $S_1$ to $S_n$, the output voltage $e_0$ represents a level of abnormality occurring at the monitoring zone. For example, when heat sensors are used as the sensors $S_1$ to $S_n$, the output voltage $e_0$ represents a heat capacity of a heat source such as a fire. The output of the operational amplifier OPA is compared with the predetermined comparison voltage $E_1$ at the comparator CMP. When the output reaches the predetermined level, an alarm signal is generated at an output terminal ARM. Based on the alarm signal, an alarm means (a buzzer of an indicator; not shown) is driven to indicate the environmental abnormality. The operational amplifier serves as a multiplying and adding means.

Generally, when signals of a plurality of sensors are processed, the sensors are separated from the signal processing circuit. Detection signals of sensors are sent to a central monitoring device through a transmission means or the like to discriminate abnormality.

Another embodiment of the device for alarming environmental abnormality of the present invention will now be described with reference to FIG. 3.

Figure 3:
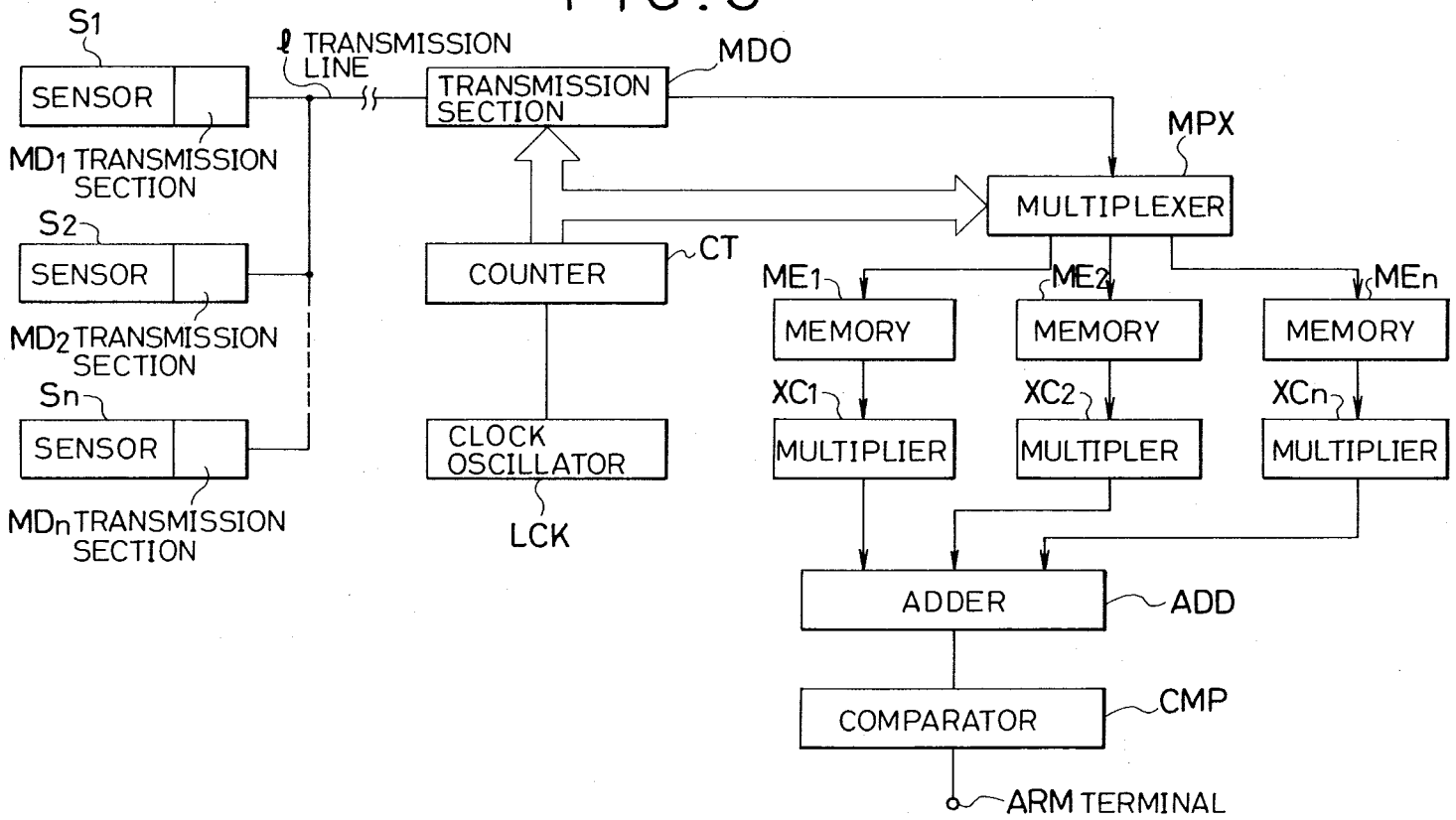
FIG. 3 is a block diagram of a device for generating an alarm signal in the event of an environmental abnormality according to another embodiment of the present invention.

The device of FIG. 3 comprises sensors $S_1$ to $S_n$, having respective transmission sections $MD_1$ to $MD_n$ provided in respective sensors $S_1$ to $S_n$. A transmission section $MD_0$ is in a central monitoring unit connected to the transmission sections $MD_1$ to $MD_n$ in the sensors $S_1$ to $S_n$ through a transmission line l. A clock oscillator LCK is provided for timing each section, and a counter CT generates a sequentially updated address signal from clock pulses of the clock oscillator LCK. A multiplexer MPX switches input response signals from the sensors $S_1$ to $S_n$ to a processing circuit corresponding to the sensors $S_1$ to $S_n$ based on the address signal of the counter CT. Memories $ME_1$ to $ME_n$ store the response signal. Multipliers $XC_1$ to $XC_n$ multiply the values of the memories with predetermined coefficients, and an adder ADD adds the outputs of the multipliers $XC_1$ to $XC_n$. A comparator CMP compares the output of the adder ADD with a predetermined comparison value.

Operation of the device having the above configuration will now be described. The counter CT supplies the sequentially updated address signal to the transmission section $MD_0$ and the multiplexer MPX based on the clock pulse of the clock oscillator LCK. The transmission section $MD_0$ generates an access signal output consisting of the address to the transmission line l. Specific addresses are assigned to the respective transmission sections $MD_1$ to $MD_n$. When access signal addresses from the central monitoring unit sent to the transmission sections $MD_1$ to $MD_n$ coincide with one or more transmission section addresses, those coinciding transmission sections supply detection signals (response data) to the transmission line l. The transmission section $MD_0$ in the central monitoring unit receives the response data from the sensors. The response data are entered in the respective memories $ME_1$ to $ME_n$, corresponding to the sensors which cupplied the response data, through the multiplexer MPX appropriately switches by the address signal from the counter CT at given timings. The memories $ME_1$ to $ME_n$ store the response data. When new data are stored in the memories $ME_1$ to $ME_n$, the multipliers $XC_1$ to $XC_n$, corresponding to the respective memories $ME_1$ to $ME_n$, multiply predetermined coefficients with the values of the data and supply the results to the adder ADD. The adder ADD output is the total sum of the outputs of the respective multipliers $XC_1$ to $XC_n$. The comparator CMP compares the adder output with the predetermined comparison value. When the output exceeds the predetermined value, the comparator CMP supplies an alarm signal to the terminal ARM. An alarm means (e.g., a buzzer or an indicator; not shown) is driven based on the alarm signal to indicate the occurrence of environmental abnormality. The predetermined coefficients for the respective multipliers $XC_1$ to $XC_n$ are proportional to the sensing volumes for the respective sensors Shd 1 to $S_n$.

The signal processing circuit (the counter CT, the multiplexer MPX, the memories $ME_1$ to $ME_n$, the multipliers $XC_1$ to $XC_n$, the adder ADD, and the comparator CMP) in the central monitoring unit is generally a microcomputer because of complexity if built using discrete components. When a plurality of different types of sensors (e.g., temperature sensors and smoke sensors) are provided in a single monitoring zone, complex discriminatin processes such as environmental abnormality discrimination can easily be performed from the result of operation (addition) of the sensors of the same type.

In addition, a misalarming due to sensor malfunctions can be prevented by not discriminating environmental abnormality when only one sensor outputs an abnormally high value.

An appropriate discrimination corresponding to the operation state at each installation site of sensors can be performed by setting the comparison value of the comparator CMP which discriminates environmental abnormality to correspond to the volume of the space to be monitored.

As described above, the device disclosed herein has a plurality of sensors in a certain monitoring zone, takes into consideration sensing volumes for respective sensors, and discriminates environmental abnormality by the total output of the sensors. More specifically, since the scale of environmental abnormality can be discriminated, a highly reliable device for alarming environmental abnormality which can reduce a misalarming, a non-alarming, and delay of an alarm to a minimum can be provided.

Although modifications and changes may be suggested by those skilled in the art it is the intention of the inventor to embody within the patent warranted hereon all changes and modifications as reasonably and properly come within the scope of his contribution to the art.

I claim as my invention:

1. A device for generating an alarm signal in the event of an environmental abnormality comprising:

a plurality of sensors disposed in respective sensing volumes for detecting a level of one or more environment conditions in each volume and coverting the level into an electrical analog signal;

means for setting a coefficient for each sensor corresponding to the sensing volume in which a sensor is disposed;

multiplying means for multiplying said coefficients with the analog signals from said sensors and providing the respective products of the multiplying at outputs;

adding means for adding the outputs of said multiplying means; and comparing means for generating said alarm signal at an output when the output of said adding means exceeds a predetermined value.

2. A device according to claim 1, wherein said multiplying means and said adding means comprise a single operational amplifier with a feedback resistor, a plurality of weighting resistors respectively connected between said sensors and said amplifier, and wherein an output $e_0$ of sid operational amplifier is given by the following equation;

$$e_0 = -\{(R_0R_1)e_1 + (R_0/R_2)e_2 + \ldots + (R_0/R_n)e_n\}$$

where $e_1 \ldots e_n$ are said analog signals of said plurality of sensors, $R_0$ is the resistance of said feedback resistor, $R_1 \ldots R_n$ are the resistances of said weighting resistors, and thus coefficients proportional to said sensing volumes are $R_0R_1$, $R_0R_2$, . . . , $R_0/R_n$.

3. A device according to claim 1, wherein said plurality of sensors respectively have terminal transmission sections;

said multiplying means, said adding means, and said comparing means constitute a signal processing circuit; and said signal processing circuit has a central transmission section for communicating with said plurality of sensors through said terminal transmission sections.

4. A device according to claim 3, wherein said multiplying means comprises a plurality of multipliers which respectively multiply the analog signals of said plurality of sensors and said coefficients.

5. A device according to claim 4, further comprising:

a plurality of memories for respectively storing said analog signals;

a counter which produces address signals for said sensors and transmits said address signals to said plurality of sensors through said central transmission section for selecting certain of said sensors for monitoring; and a multiplexer for switching incoming analog signals for entry in an associated one of said memories in response to said address signals.

6. A device according to claim 5, wherein said counter, said multiplexer, said memories, said multipliers, said adding means, and said comparing means constitute a microcomputer.

7. A device for generating an alarm signal in the event of an environmental abnormality comprising:

a plurality of sensors disposed in respective sensing volumes for detecting a level of one or more environmental conditions in each volume and converting the level into an electrical analog signal;

a like plurality of transmission sections respectively associated and disposed with said plurality of sensors, each transmission section having a different address;

a central monitoring unit including means for exchanging information with said sensors via said respective transmission sections;

means in said central monitoring unit for selectively addressing said transmission sections for obtaining data from the sensor associated therewith;

a like plurality of memories in said central monitoring unit for respectively storing data from said plurality of sensors;

a multiplexer connected to each of said memories and to said means for exchanging information and to said means for addressing said transmission sections for entering incoming data from a sensor in the memory associated therewith;

a like plurality of multipliers each having an input connected to an output of one of said memories for multiplying the data stored in said one of said memories by a coefficient porportional to the sensing volume in which the sensor associated with said one of said memories is disposed;

an adder having a plurality of inputs respectively connected to outputs of said multipliers for adding all of said multiplier outputs; and a comparator for comparing the output of said adder to a selected value and for generating an alarm signal based on the result of the comparison.

* * * * *